US005580285A

United States Patent [19]

Vanzetto

[11] Patent Number: 5,580,285

[45] Date of Patent: Dec. 3, 1996

[54] CONNECTION TERMINAL FOR AN ELECTRICAL APPARATUS

[75] Inventor: Daniel Vanzetto, Claix, France

[73] Assignee: Schneider Electric S.A., France

[21] Appl. No.: 442,567

[22] Filed: May 16, 1995

[30] Foreign Application Priority Data

Jun. 6, 1994 [FR] France ..... 94 07099

[51] Int. Cl.[6] ..... H01R 4/36

[52] U.S. Cl. ..... 439/810; 439/811

[58] Field of Search ..... 439/810, 811, 439/801, 723

[56] References Cited

U.S. PATENT DOCUMENTS 3,539,977 11/1970 Woertz ..... 439/811
4,790,778 12/1988 Seidenbusch ..... 439/811

FOREIGN PATENT DOCUMENTS 2612340 9/1988 France .
732062 2/1943 Germany .
2537469 3/1977 Germany .
8312142 11/1983 Germany .

*Primary Examiner*—Neil Abrams
*Assistant Examiner*—Brian J. Biggi
*Attorney, Agent, or Firm*—Parkhurst, Wendel & Burr, L.L.P.

[57] ABSTRACT

The present invention relates to a connection terminal for an electrical switchgear apparatus, designed to prevent incorrect connection of a cable.

This terminal comprises a tunnel, a contact pad and a tightening screw. At its lower part, the tunnel is provided with two protuberances arranged to cooperate with two flexible hooks of a shield. This shield is formed by a rigid plate which can be securedly affixed to the tunnel to partially mask the opening of the tunnel when an electrical wire or cable of small diameter is connected.

The fit-on shield is advantageous in that it enables all conditions of use to be met.

8 Claims, 4 Drawing Sheets

CONNECTION TERMINAL FOR AN ELECTRICAL APPARATUS

BACKGROUND OF THE INVENTION

The present invention relates to a connection terminal for an electrical switchgear apparatus, comprising a tunnel, a contact pad and a tightening screw.

The connection terminals of some electrical switchgear are provided with a strip, called a shield, designed to prevent incorrect connection of a cable by inserting the bared end of the cable into an opening of the tunnel of the terminal. In the case where the tunnel is mobile, the latter moves when tightening of the cable previously inserted into a suitable opening is performed by means of a screw. This movement of the tunnel opens up a space, and the access to this space may be accidentally taken to be an opening of the tunnel. Such an error results in a deficient or even dangerous connection.

To avoid this risk, certain tunnels have been equipped with fixed shields which suitably fulfill the preventive function for which they are designed. However, these shields are not useful or desirable on all electrical switchgear apparatuses. It is therefore necessary to provide terminals provided with tunnels equipped with such shields and terminals provided with tunnels not equipped with these shields. This requires distinct manufacturing, assembly and storing, and has the consequence of making the product more expensive and of making complications for the user.

SUMMARY OF THE INVENTION

The object of the present invention is to overcome this drawback by achieving a standard connection terminal able to be used with or without a shield according to the requirements involved in the envisaged application.

For this purpose, the connection terminal according to the invention is characterized in that the tunnel is equipped with a removable shield, and with joining means arranged to enable said shield to be fitted.

According to an advantageous embodiment, the tunnel is provided with joining means arranged to enable clip-on fitting of the shield made in one piece in the form of a rigid plate. According to other embodiments, the shield is formed by two or more elements sliding with respect to one another. It can also be formed by one or more retractable flexible elements.

BRIEF DESCRIPTION OF THE DRAWINGS

The present invention will become more clearly apparent from the following description of embodiments given as nonrestrictive examples only and represented in the accompanying drawings in which.

DETAILED DESCRIPTION OF THE PREFERRED EMBODIMENT

Figures 1, 4:
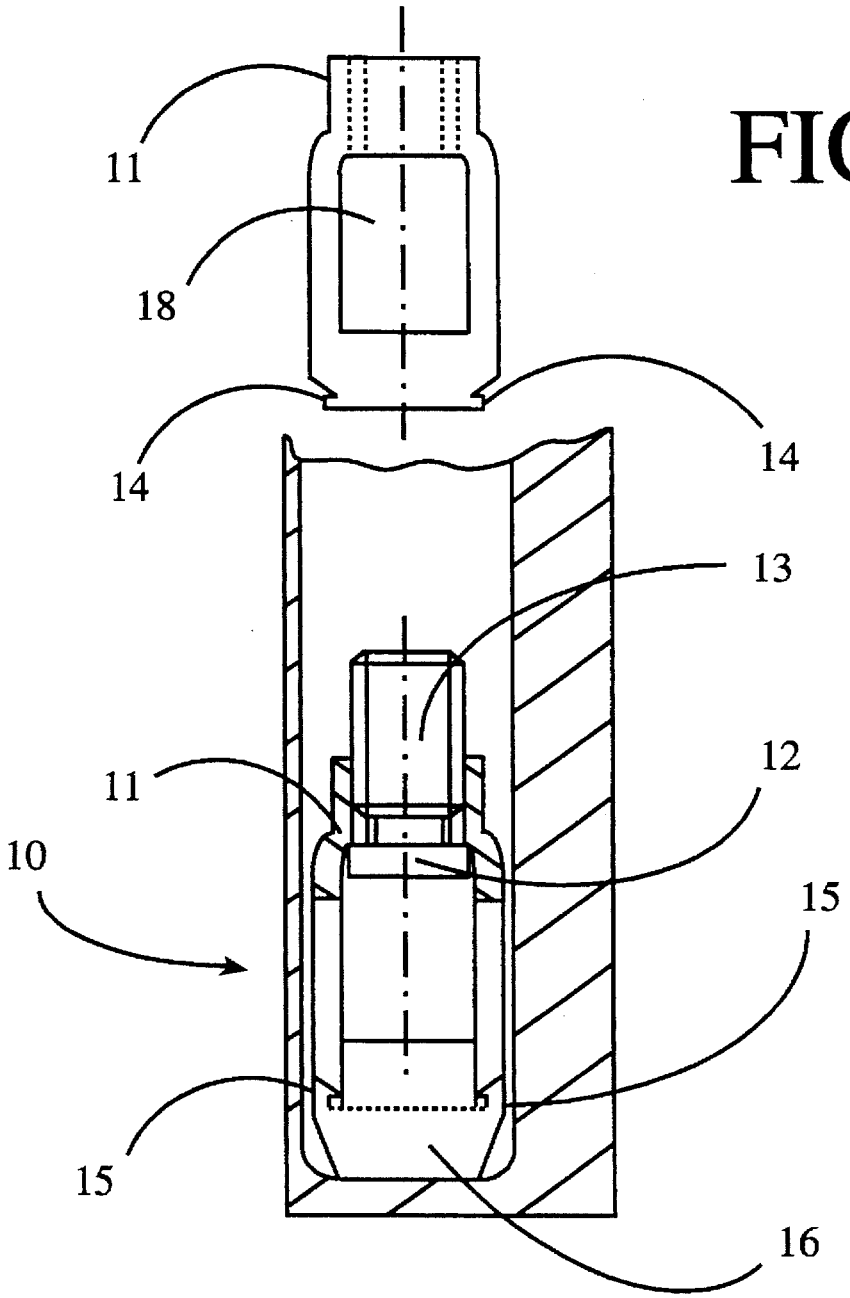
FIG. 1 represents a tunnel of a connection terminal of an electrical apparatus, this tunnel being equipped with a shield designed according to a first embodiment.
FIG. 4 represents the tunnel of FIG. 1 not equipped with a shield.

With reference to FIGS. 1 to 4, the connection terminal 10 comprises a tunnel 11, a contact pad 12 and a tightening screw 13. The tunnel 11 is preferably made of drawn aluminium having internal walls which are threaded to be able to receive the tightening screw 13. At its base, the tunnel 11 is provided with clipping means in the form of two lateral protuberances 14, arranged to cooperate with two hooks 15 of a removable shield 16 which can be fitted, if this is necessary or useful for the electrical assembly made. This shield is advantageously made of synthetic material and the hooks 15 present sufficient flexibility to be able to clip onto the lateral protuberances 14.

Figures 2, 3:
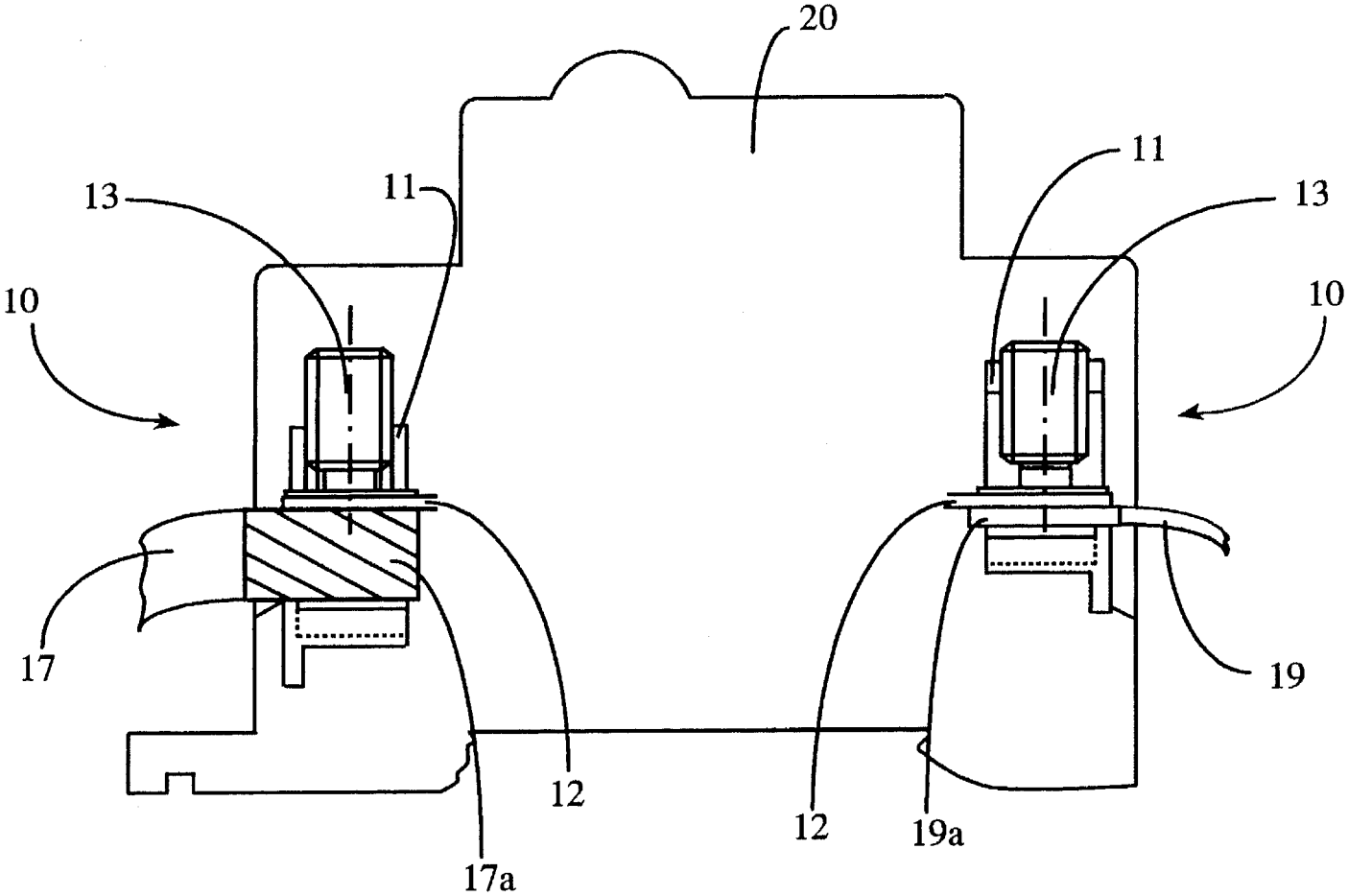
FIG. 2 represents the tunnel of FIG. 1 used to connect a large diameter cable.
FIG. 3 represents the tunnel of FIG. 1 used to connect a small diameter cable.

Thanks to this fit-on shield, the tunnel becomes a standard element which can, according to the application envisaged, be equipped with this shield or not. FIG. 1 represents the tunnel equipped with the shield. FIG. 4 represents the tunnel not equipped with the shield. FIG. 2 represents the tunnel equipped with the shield and used as a terminal of an electrical apparatus 20 to connect a large diameter cable 17. In this case, the shield occupies a relatively low position, as the bared end 17*a* of the cable 17 occupies the largest part of the internal cavity corresponding to the opening 18 of the tunnel. FIG. 3 represents the tunnel equipped with the shield and used as a terminal of the electrical apparatus 20 to connect a small diameter cable 19. In this case, the shield occupies a high position, as the bared end 19*a* of the cable 19 occupies a small part of the volume of the internal cavity of the tunnel. The risks of connection error are therefore high, because it would be easy to accidentally insert other cables into the opening of the tunnel. This results in the shield having its justification and fulfilling its function.

In the example illustrated by the foregoing figures, the shield is a rigid plate made in a single part, for example by stamping, moulding, thermoforming etc. Other constructions are envisageable and will be described as examples with reference to the following figures.

Figure 6:
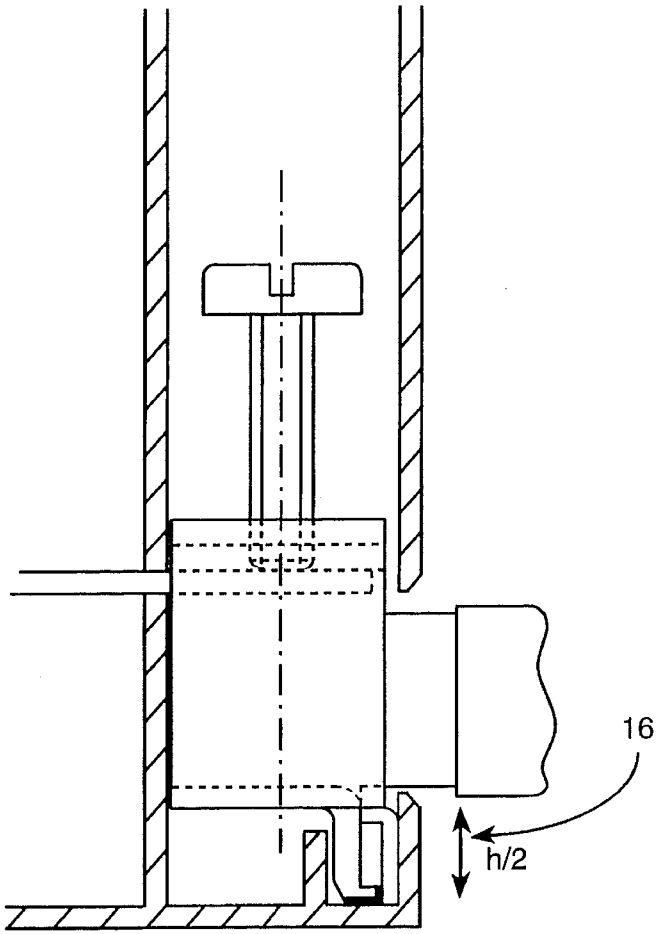
FIGS. 5 and 6 represent a tunnel equipped with a shield designed according to a second embodiment.
Figure 5:
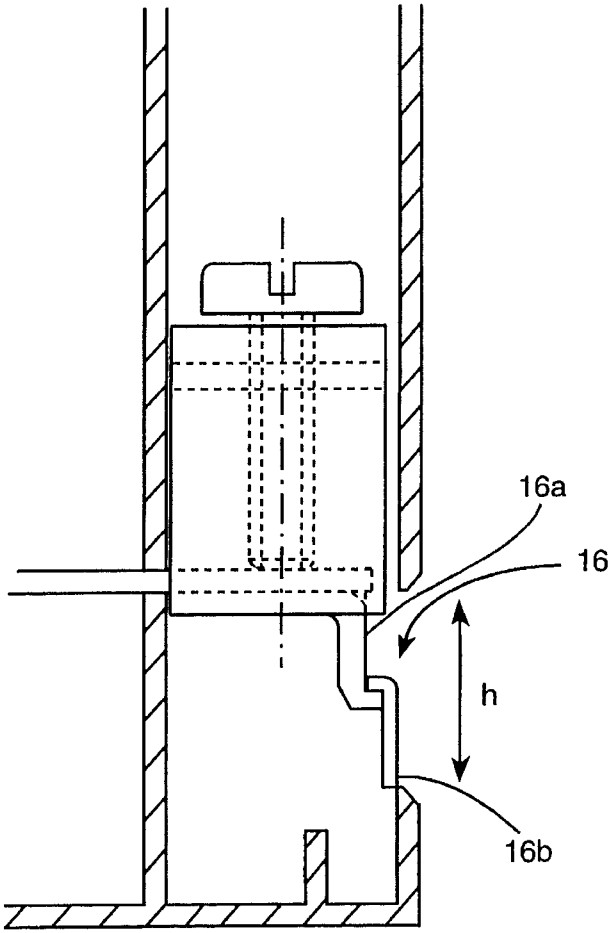

FIGS. 5 and 6 represent a construction wherein the shield 16 is made of two elements sliding with respect to one another. In order to reduce the dimensions of the tunnel, the height necessary to accommodate the shield can be decreased if this shield is made of two or more elements joined to one another, but sliding. In the example represented, the shield 16 comprises a first element 16*a* and a second element 16*b*. The total height of the shield in the opened out state is h. The height of each element is appreciably h/2, which corresponds to the height of the shield in the folded state. The opened out state is that which corresponds to connection of a small diameter cable and the folded state is that which corresponds to connection of a large diameter cable. All the intermediate positions are obviously possible.

Figure 8:
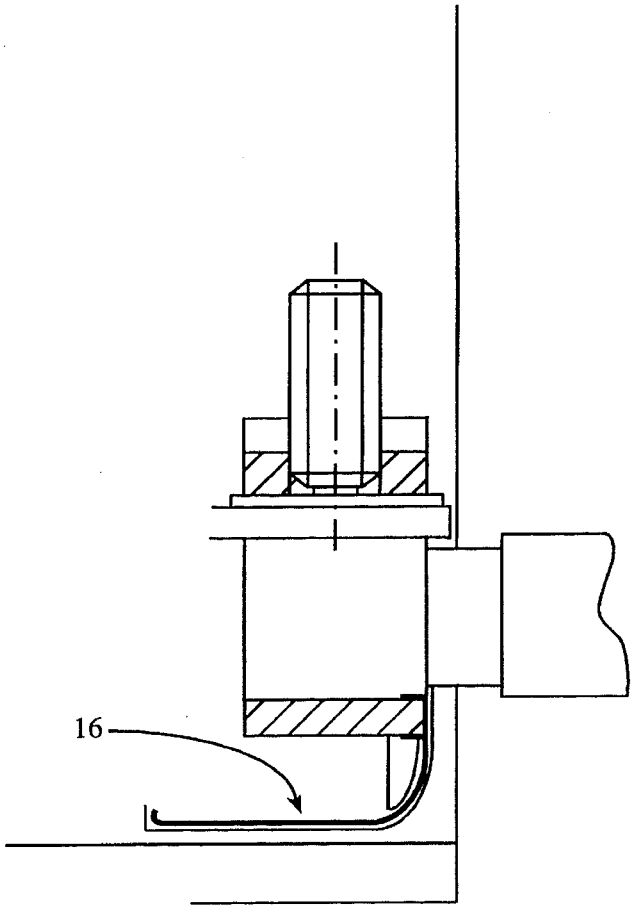
FIGS. 7 and 8 represent a tunnel equipped with a shield designed according to a third embodiment.
Figure 7:
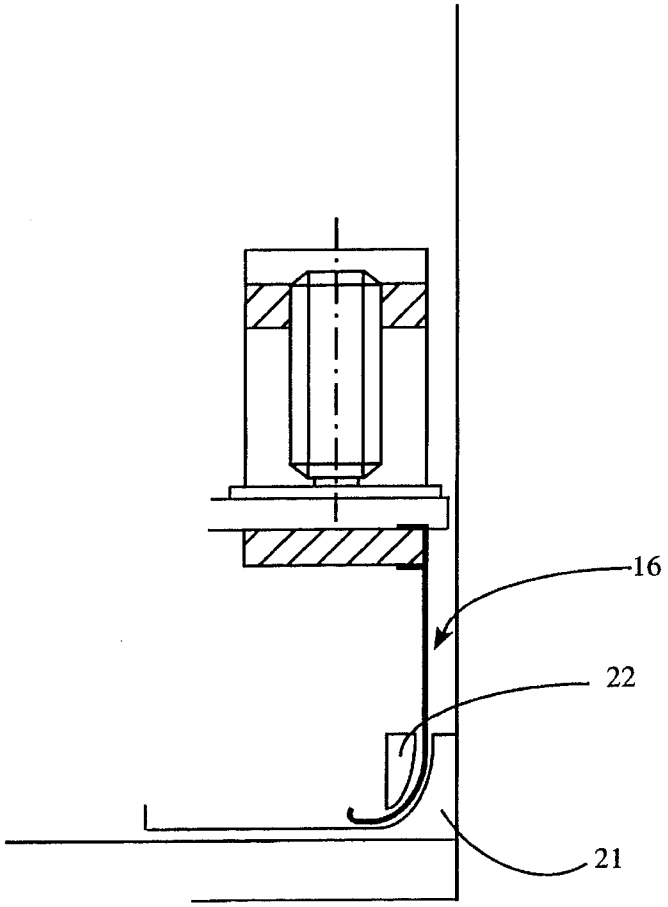

FIGS. 7 and 8 represent a construction wherein the shield 16 is flexible and retractable and can be achieved in the form of a flexible sheet or of several leaves articulated with respect to one another. It is then disposed between the guiding elements 21, 22 which enables it to perform its shielding function in the manner of a roll-up blind. FIG. 7 shows such a shield unfurled. When the connected cable is of large diameter, the shield is partially or totally retracted as shown in FIG. 8.

In this embodiment, the heightwise dimension can be greatly reduced, the height of the shield in the retracted state being very small. In all cases, the shield is fitted on, which leaves the choice of whether to equip the tunnel with a shield or not up to the user.

I claim:

1. A connection terminal for an electrical switchgear apparatus, comprising a tunnel, a contact pad and a tightening screw, wherein the tunnel is equipped with a removable shield, and with joining means arranged to enable said shield to be fitted to said tunnel.

2. The connection terminal according to claim 1, wherein said joining means of the tunnel comprise two protuberances cooperating by clipping with two flexible hooks of said shield.

3. The connection terminal according to claim 1, wherein said shield is a rigid plate made in a single part.

4. The connection terminal according to claim 1, wherein said shield comprises at least two elements sliding with respect to one another.

5. The connection terminal according to claim 4, wherein said shield is formed by a flexible sheet.

6. The connection terminal according to claim 4, wherein said shield is formed by several leaves articulated with respect to one another.

7. The connection terminal according to claim 1, wherein said shield is formed by a retractable flexible element.

8. The connection terminal according to claim 7, wherein the tunnel comprises guide means of said retractable flexible element.

* * * * *